US006735970B1

(12) United States Patent
Bocchini

(10) Patent No.: US 6,735,970 B1
(45) Date of Patent: May 18, 2004

(54) REFRIGERATED COUNTER FOR BARS, PASTRY OR ICE CREAM SHOPS EQUIPPED WITH OPTICAL FIBRE INTERNAL LIGHTING SYSTEM

(75) Inventor: Augusto Bocchini, Jesi (IT)

(73) Assignee: Bocchini S.p.A., Monsano (IT)

( * ) Notice: Subject to any disclaimer, the term of this patent is extended or adjusted under 35 U.S.C. 154(b) by 0 days.

(21) Appl. No.: 10/361,745

(22) Filed: Feb. 6, 2003

(51) Int. Cl.[7] ..... A47F 3/04
(52) U.S. Cl. ..... 62/246; 62/264
(58) Field of Search ..... 62/246, 264; 385/31, 385/38, 147

(56) References Cited

U.S. PATENT DOCUMENTS 4,949,082 A * 8/1990 Yazdani et al. ..... 340/783
5,701,235 A * 12/1997 Hagemeyer Cook et al. . 362/26
5,836,669 A * 11/1998 Hed ..... 362/92
6,351,584 B1 * 2/2002 Horie et al. ..... 385/31
2003/0154732 A1 * 8/2003 Bassi

FOREIGN PATENT DOCUMENTS

| | | | |
|---|---|---|---|
| EP | G 4404247 A1 | * | 8/1995 |
| FR | 2653214 A | * | 4/1991 |
| GB | 2135292 A | * | 8/1984 |
| JP | 09308818 A | * | 12/1997 |
| JP | 10141845 A | * | 5/1998 |

* cited by examiner

*Primary Examiner*—Harry B. Tanner
*Assistant Examiner*—Mohammad M. Ali
(74) *Attorney, Agent, or Firm*—Armstrong, Kratz, Quintos, Hanson & Brooks, LLP

(57) ABSTRACT

The present invention relates to a refrigerated counter for bars, pastry or ice cream shops equipped with optical fibre internal lighting system, having box-shaped shelves with special lower profile in such a way that the light emitted by the optical fibres located inside the lower profile completely illuminates the surface of the underlying shelf.

5 Claims, 2 Drawing Sheets

REFRIGERATED COUNTER FOR BARS, PASTRY OR ICE CREAM SHOPS EQUIPPED WITH OPTICAL FIBRE INTERNAL LIGHTING SYSTEM

The present patent application relates to a refrigerated counter for bars, pastry or ice cream shops equipped with optical fibre internal lighting system. The use of optical fibres to illuminate the shelves of similar counters is particularly interesting, since the light emitted by the optical fibres is"cold", that is to say has no thermal energy emission, unlike the light produced by traditional neon lamps.

Since neon lamps produce a considerable amount of heat, refrigerated counters are always provided with cooling system including heat exchangers located near each neon lamp, in order to absorb the thermal energy emitted by the lamps. This is done in order to avoid the expensive over-dimensioning of the refrigerator unit used to control and adjust the air temperature inside the display compartment of the counter.

The use of the optical fibre lighting system avoids the need for a cooling system, making the counter construction easier and less expensive. Notwithstanding the above, optical fibres are not used in the shelves of refrigerated counters, due to the difficulties encountered to illuminate the shelves with satisfactory intensity and uniformity.

As it is known, while neon lamps emit diffused light that irradiates in all directions, the "cold" light emitted by optical fibres is a punctual light, meaning that light irradiates in space according to a light cone, with the vertex positioned on the luminous end of the optical fibre.

This obviously results in a series of problems, with reference to the number and position of the optical fibres, in order to illuminate the entire surface of the counter with a contiguous series of light cones.

In other words, the optical fibre lighting system for counters used in bars, pastry or ice cream shops, bakeries or delicatessen stores must guarantee the necessary lighting on all display surfaces, without disturbing the operator or customer. Moreover, since the volume of the illuminator must be reduced due to the limited space under the display compartment, the dimensions of the lighting system must be optimised, in order to use the lowest possible number of optical fibres, while guaranteeing satisfactory uniform lighting on all display surfaces.

The purpose of the invention is to provide a solution to the aforementioned problem, by studying the geometrical configuration of the shelves and the orientation of the optical fibres above each shelf, in order to ensure satisfactory lighting on all display areas.

For major clarity the description of the invention continues with reference to the enclosed drawings whereby:

Figure 1:
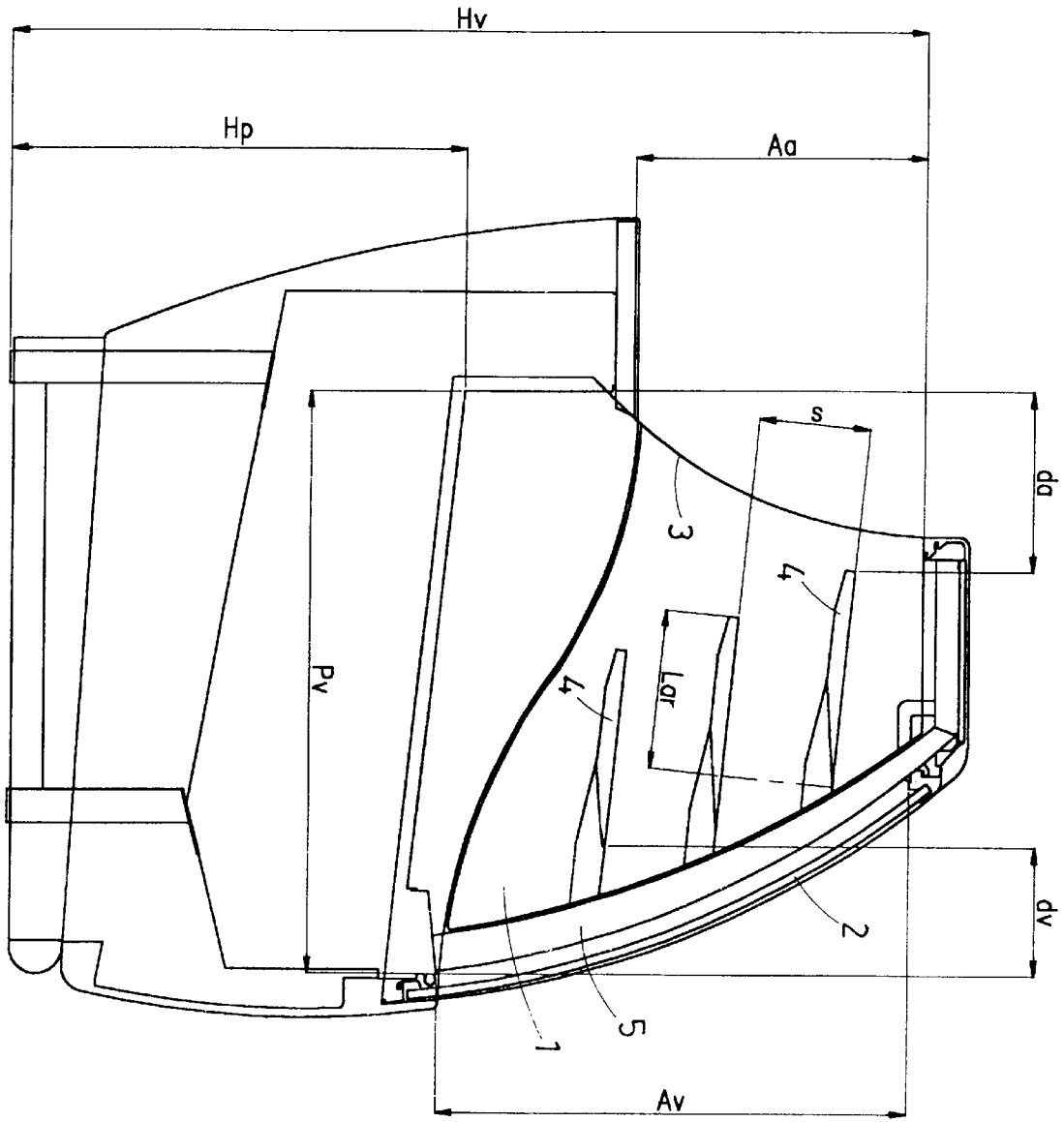
FIG. 1 is the transversal cross section of a refrigerated counter with shelves having suitable geometrical configuration in order to achieve the aim of the invention.
Figure 2:
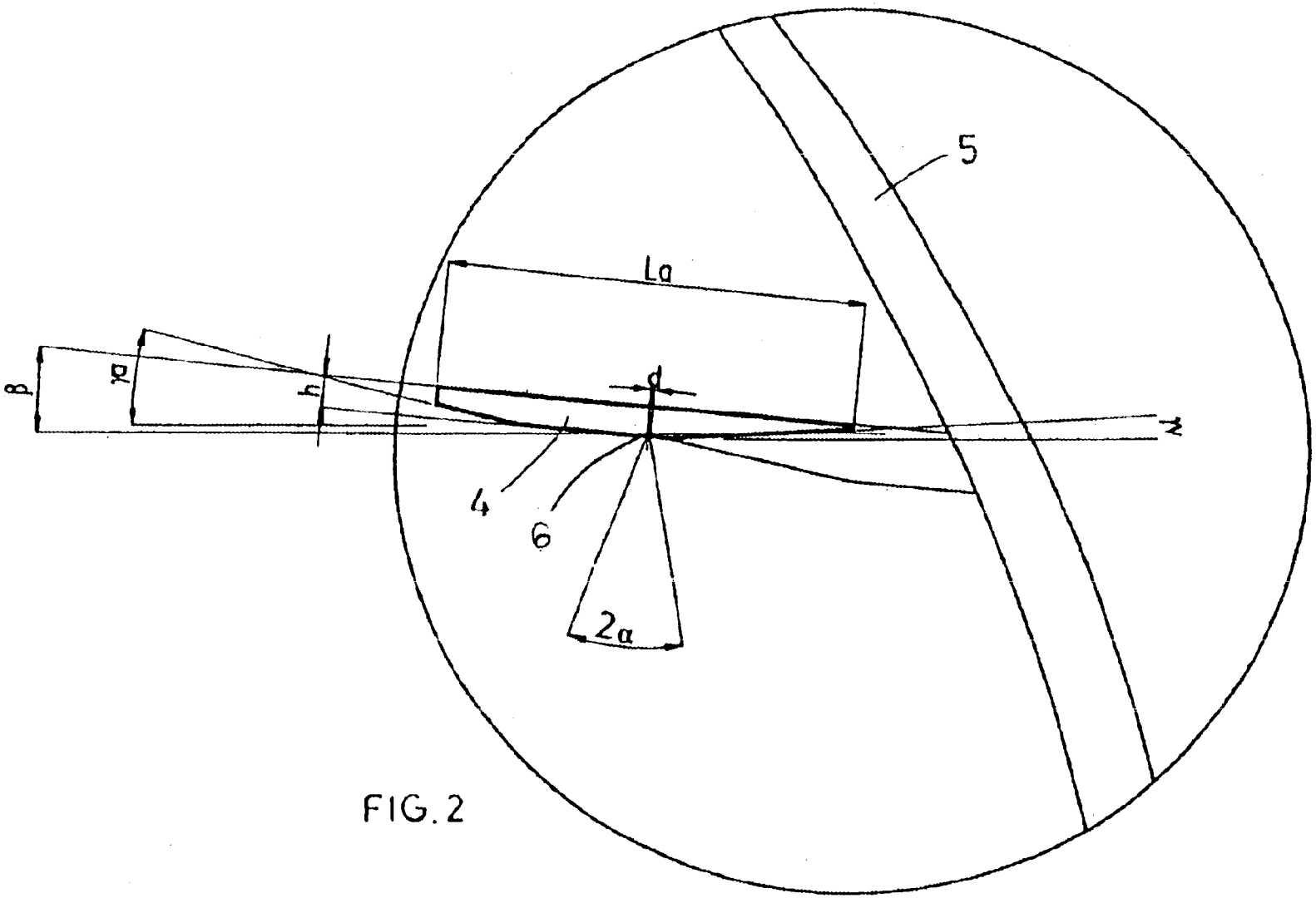
FIG. 2 is an enlarged view of a shelf of FIG. 1.

With reference to the aforementioned figures, the counter of the invention comprises a refrigerated compartment (1) closed on the front, that is to say the side towards the customer, a glass surface (2) with curved profile, and an opening (3) on the back, that is to say the side towards the operator, used by the operator to introduce or remove the products that are positioned on a series of shelves (4) fixed to support uprights (5).

First of all, it must be noted that the geometrical configuration of traditional counters can be considered as the body obtained from the translation or rotation of a plane surface, which coincides with the transversal cross section of the counter. For this reason, the solution to the problem has been devised using such a cross section as a reference, since once the conditions for the correct lighting of the shelves for a generic transversal cross section of the counter have been identified, the compliance with the same conditions for the other cross section can guarantee the correct lighting of the shelves along entire length of the counter.

Being the shelves (4) arranged in a vertical sequence, we can define a covering factor expressed as:

$$\zeta = Lar/La$$

where:

(La) is the width of the shelf (4) (usually ranging from 500 to 150 mm);

(Lar) is the section of the width (La) covered by the shelf (4) above;

($\zeta$) is the covering factor.

Obviously, ($\zeta$) ranges from 1 to 0 due to the different geometry of the counter according to the different use.

By defining:

(s) as the relative distance between the shelves (4), normally ranging from 300 to 100 mm;

($\alpha$) as the opening half angle of the light cone of the optical fibre, according to the type of terminal used;

the area illuminated by the optical fibre shall be:

$$Ai = \pi \cdot s^2 \cdot \tan^2 \alpha \qquad (A)$$

if the optical fibre internal lighting system (6) inside the lower surface of each shelf (4) are directed in such a way that the axis of the light cone is perpendicular to the surface of the shelf (4) below, the uncovered part of the shelf (with width equal to La—Lar) will be illuminated only in case of compliance with the relationship:

$$ai = 2(1-\zeta) \qquad (B)$$

or $$\pi \cdot s^2 \cdot \tan^2 \alpha = 2(1-\zeta) \qquad (C)$$

in the counter length unit.

In the relationship (C) the distance (s) is the only variable, although with two limit values: a minimum value conditioned by the need to access the products displayed on the shelves and a maximum value conditioned by the maximum possible height of the counter.

In other words the value of the distance (s) must comply with the following condition:

$$Hv - Hp = N \cdot (s+h) \qquad (D)$$

where:

(Hv) is the total height of the counter, normally ranging from 1600 to 500 mm;

(Hp) is the height of the lower edge of the opening (3) from the ground, normally ranging from 900 to 500 mm;

(N) is the number of shelves (4) ranging from 4 to 1;

(h) is the thickness of the shelf (4) with box-shaped configuration in order to house the bundle of optical fibres.

It must be noted that the thickness (h) of each shelf is conditioned by a series of factors, such as: structural resistance requirements, optical fibre diameter (d: ranging from 8 to 1 mm), distance between lights in longitudinal direction (p: ranging from 50 to 10 mm) and number of lights in transversal direction (n: ranging from 6 to 1).

Conclusively, in order for the light cone to illuminate the shelf below in a uniform way, the variable (s) must comply with the aforementioned conditions (C) and (D).

In view of the difficulties to comply with both conditions, (s) values in compliance with condition (B) only are used, while giving a different inclination to the axis of the light cone, which is no longer perpendicular to the surface of the shelf below, as defined for relationship (C).

In other words, the configuration of the lower side of each shelf (4) comprises a central section in parallel position to the upper side and two ending sections with inclination angles ($Y_v$ and $Y_a$) with respect to the central section. The angles ($Y_v$ and $Y_a$) are the inclination angles on the customer and operator's side, respectively.

In order for the light cone emitted by the optical fibre positioned in one of the two inclined ending sections to completely illuminate the uncovered section of the shelf below, the inclination angles ($Y_v$ and $Y_a$) must have a minimum value that complies with the following relationships, respectively:

$$\text{sen}(\beta+Y_v)=\text{sen}\alpha/(1-\zeta) \quad \text{(E1)}$$

$$\text{sen}(\beta+Y_a)=\text{sen}\alpha/(1-\zeta) \quad \text{(E2)}$$

where:

$\beta$ is the inclination angle of the shelves (4) with respect to the horizontal direction, ranging from 12° to 0°.

The inclination angles ($Y_v$ and $Y_a$) cannot exceed a maximum value to avoid that the light cone interferes with the customer or operator's visual angle. The maximum value depends on the following parameters:

the height (Av) of the transversal area of the glass surface (2) measured on the customer's side;

the height (Aa) of the transversal area of the opening (3) on the operator's side;

the depth (Pv) of the compartment (1), normally ranging from 1000 to 600 mm;

the distance (da) between optical fibres and operator;

the distance (dv) between optical fibres and customer.

The aforementioned parameters are governed by the following relationship:

$$dv+da=Pv-La\cdot N\cdot(1-\zeta) \quad (F)$$

In order for the light cone not to reach the operator or customer, it is necessary that:

$$\tan\delta_v \leqq dv/Av$$

$$\tan\delta_a \leqq da/Aa$$

where:

$$\delta_v=(\alpha+Y_v-\pi)/2$$

$$\delta_a=(\alpha+Y_a-\pi)/2$$

What is claimed is:

1. Refrigerated counter for bars, pastry or ice cream shops equipped with an optical fibre internal lighting system, comprising a refrigerated compartment (1) having a closed glass surface (2) front oriented toward a customer and a back having an opening (3) therein oriented towards an operator, the opening being used by the operator to access a vertical series of shelves (4), characterised by:

the shelves (4) having an upper plane side with width (La) and a lower side with a central section parallel to the upper plane side and two ending sections with inclination angles ($Y_v$ and $Y_a$) with respect to the central section;

the value of each angle ($Y_v$ and $Y_a$) ranging between two maximum values in compliance with the following conditions:

$$\tan\delta_v=dv/Av$$

$$\tan\delta_a=da/Aa$$

where:

(Av) is a height of the glass surface (2) measured on the front;

(Aa) is a height of the opening (3) on the back;

(da) is a distance between the optical fibre lighting system and the operator;

(dv) is a distance between the optical fibre lighting system and the customer;

$\delta_v=(\alpha+Y_v-\pi)/2$;

$\delta_a=(\alpha+Y_a-\pi)/2$; and two minimum values in compliance with the following:

$$\sin(\beta+Y_v)=\sin\alpha/(1-\zeta)$$

$$\sin(\beta+Y_a)=\sin\alpha/(1-\zeta)$$

where:

($\beta$) is an inclination angle of the shelves (4) with respect to a horizontal plane, ($\zeta$) is a covering factor defined as a width of the shelf (La) divided into a section (Lar) of the width covered by a shelf above, ($\alpha$) is an opening half angle of a light cone of the optical fibre, according to a type of terminal used.

2. The refrigerated counter of claim 1, having a plurality of vertically spaced-apart shelves, each shelf having a source of illumination on a lower surface thereof, the illumination being directed to the shelf below, each shelf having a planar upper surface, and the lower surface having chamfered opposite ends, wherein maximum illumination is provided for each shelf.

3. The refrigerated counter of claim 2, wherein the lower surface of each shelf has a central portion parallel to the upper surface and the chamfered opposite ends have inclination angles $Y_v$ and $Y_a$ with respect to the central portion.

4. The refrigerated counter of claim 2, wherein the planar upper surface of each shelf is at an inclination angle of 0–12° with respect to a horizontal plane.

5. The refrigerated counter of claim 2, wherein the source of illumination is optical fibre.

* * * * *